United States Patent [19]

Espenscheid et al.

[11] 4,052,292

[45] Oct. 4, 1977

[54] LIQUEFACTION OF SOLID CARBONACEOUS MATERIALS

[75] Inventors: Wilton F. Espenscheid, Princeton, N.J.; Tsoung-Yuan Yan, Philadelphia, Pa.

[73] Assignee: Mobil Oil Corporation, New York, N.Y.

[21] Appl. No.: 664,220

[22] Filed: Mar. 5, 1976

[51] Int. Cl.[2] ..... C10G 1/04

[52] U.S. Cl. ..... 208/8; 201/23

[58] Field of Search ..... 208/8, 10; 44/51; 201/23

[56] References Cited

U.S. PATENT DOCUMENTS

| | | | |
|---|---|---|---|
| 1,512,577 | 10/1924 | Blythe | 201/23 |
| 1,864,687 | 6/1932 | Fields | 208/8 |
| 1,959,467 | 5/1934 | Fields | 208/8 |
| 2,054,725 | 9/1936 | Greenstreet | 201/23 |
| 2,412,879 | 12/1946 | Fischer | 201/23 |
| 3,642,608 | 2/1972 | Roach et al. | 208/8 |
| 3,705,092 | 12/1972 | Gatsis | 208/8 |

*Primary Examiner*—Delbert E. Gantz
*Assistant Examiner*—James W. Hellwege
*Attorney, Agent, or Firm*—Charles A. Huggett; Carl D. Farnsworth

[57] ABSTRACT

This invention provides a method for solubilizing wood or wood and coal mixtures in a highly aromatic refinery petroleum solvent to produce homogeneous compositions which have a flowable pitch-like consistency at ambient temperatures. The invention compositions are directly applicable as liquid fuels, or can be further processed into other desirable products.

9 Claims, No Drawings

LIQUEFACTION OF SOLID CARBONACEOUS MATERIALS

BACKGROUND OF THE INVENTION

Natural resources provide substantially all of man's energy source materials in the form of fossil fuels, wood and other types of plant life.

Wood and coal have been a principle source of fuel for hundreds of years. Within the last one hundred years, petroleum has become the overwhelming primary commodity for the generation of energy. Petroleum has had the advantages of low cost and ease of transportation and storage because of its liquid consistency. Further, petroleum is readily amenable to fractionation and conversion into a variety of valuable industrial products such as fuels, building products, chemical intermediates and the like.

Recent international economic developments have signaled the inevitable decline of petroleum as the world's supreme industrial commodity. The price of raw petroleum has increased several fold. Also, the consumption of petroleum has been increasing exponentially and concomitantly the world petroleum supply has diminished to less than several decades of proven reserves.

Governments and industrial concerns on a priority basis are dedicating increased attention to alternatives to petroleum as sources for fuels and chemical intermediates, i.e., coal and wood. Substantial reserves of coal exist in highly industrialized countries, and wood is both plentiful and replenishable worldwide.

Since most current energy utilization technology requires liquid energy media, it has become an important research and development objective to provide innovative means to convert coal and wood into liquid sources of potential energy.

It was recognized by early workers that both coal and wood can be liquified by controlled heating in the substantial absence of oxygen. The conversion products are a liquid, gas and a char. Because of the new compelling economic factors, the technology of coal liquefaction and gasification has been expanding at an accelerated pace. Pioneer developments in the field are represented by Lurgi and Fischer-Tropsch technology. More recent advances in coal liquefaction are described in U.S. Pat. Nos. 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

The destructive distillation of wood to produce charcoal, oils and gases has been known for centuries. In a recent publication, an American company reported a process for producing as much as two barrels of oil per ton of tree bark by a controlled pyrolysis process. The United States Bureau of Mines, in publication Number 8013 entitled "Conversion of Cellulosic Wastes To Oil", reports 90–99 weight percent conversion of sawdust with 40–60 weight percent yields of oil by reaction with synthesis gas at a temperature of 250°–425° C and a pressure of 1500–4000 psig, in the presence of water and an inorganic catalyst.

There remains a pressing need for new technology for the conversion of coal and wood into liquid carbonaceous products to complement and to enhance conventional petroleum derived energy and chemical applications. Innovative processes for liquefaction of coal and wood are required which are not dependent on high pressures or reducing gases or catalysts for efficient and economic liquefaction of coal and wood.

It is an object of the present invention to provide an improved method for converting solid carbonaceous materials into gaseous and liquid derivatives having application as fuels and chemical intermediates.

It is another object of the present invention to provide a process for the liquefaction of carbonaceous materials without the use of high pressures, reducing gases, or catalysts.

It is another object of the present invention to solubilize wood and wood/coal mixture to form flowable pitchlike compositions which are directly applicable as liquid fuels.

It is a further object of the present invention to upgrade low value refractory petroleum residua from refinery operations into gaseous and liquid fuel media.

Other objects and advantages of the present invention shall become apparent from the accompanying description and examples.

DESCRIPTION OF THE INVENTION

One or more objects of the present invention are accomplished by a process for liquefaction of solid carbonaceous materials which comprises forming a slurry by admixing comminuted wood with a thermally stable refinery petroleum residuum having a boiling point between about 450° F and 1100° F and heating said slurry at a temperature in the range between about 350° F and 850° F for a period of time sufficient to convert the slurry into a homogeneous composition which has a pitch-like consistency at temperatures in the range of 20° F up to about 200° F.

By the term "wood" is meant fibrous plant material which consists substantially of cellulose and lignin.

By the term "thermally stable" refinery petroleum fractions is meant a relatively high boiling petroleum conversion product of fluidized catalytic cracking obtained as (FCC) "main column" bottoms or a product of thermofor catalytic conversion (TCC) obtained as "syntower" bottoms. These materials contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, and their derivatives. Such highly refractory petroleum media or bottoms are highly resistant to conversion to lower molecular products by conventional non-hydrogenative procedures. Typically, these petroleum refinery bottoms and some lower boiling recycle fractions are hydrocarbonaceous mixtures having an average carbon to hydrogen atomic ratio in the range of about 0.6–1.3, and a boiling point above about 450° F.

The petroleum solvents suitable for the practice of the present invention process are preferably thermally stable, highly polycyclic aromatic rich mixtures which result from one or more petroleum refining operations comprising catalytic cracking. Representative heavy or high boiling petroleum solvents include main column and syntower bottoms; asphaltic material; alkanedeasphalted tar; coker gas oil; heavy cycle oil; clarified slurry oil; mixtures thereof, and the like. The nominal properties of suitable petroleum solvents are as follows:

| | Main Column Bottoms |
|---|---|
| Sulfur | 1.13% |

-continued

| | |
|---|---|
| Nitrogen | 450 ppm |
| Pour Point | 50° F |
| 5% Boiling Point | 640° F |
| 95% Point | 905° F |
| Conradson Carbon | 9.96 |
| Clarified Slurry Oil | |
| Sulfur | 1.04% |
| Nitrogen | 4400 ppm |
| Pour Point | 50° F |
| 5% Boiling Point | 630° F |
| 95% Point | 924° F |
| Conradson Carbon | 10.15 |
| Heavy Cycle Oil | |
| Sulfur | 1.12% |
| Nitrogen | 420 ppm |
| 5% Boiling Point | 450° F |
| 95% Point | 752° F |
| Conradson Carbon | 0.15 |

An FCC "main column" bottoms refinery fraction is a highly preferred solvent for the practice of the present invention process. A typical FCC "main column" bottoms contains a mixture of chemical constituents as represented in the following mass spectrometric analysis:

| Compounds | Aromatics | Napthenic/ Aromatics | Labile $H_2$% |
|---|---|---|---|
| Alkyl Benzene | 0.4 | | 0 |
| Naphthene Benzenes | | 1.0 | 0.03 |
| Dinaphthene Benzenes | | 3.7 | 0.16 |
| Naphthalenes | 0.1 | | 0 |
| Acenaphthenes, (biphenyls) | | 7.4 | 0.08 |
| Fluorenes | | 10.1 | 0.11 |
| Phenanthrenes | 13.1 | | |
| Naphthene phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.1 | | 0 |
| Benzothiophenes | 2.4 | | |
| Dibenzothiophenes | 5.4 | | |
| Naphthobenzothiophenes | | 2.4 | 0.04 |
| Total | 64.4 | 35.6 | 0.60 |

A typical FCC "main column" bottoms has the following nominal analysis and properties:

| | |
|---|---|
| Elemental Analysis, Wt. %: | |
| C | 89.93 |
| H | 7.35 |
| O | 0.99 |
| N | 0.44 |
| S | 1.09 |
| Total | 99.80 |
| Pour Point, ° F: 50 | |
| CCR, %: 9.96 | |
| Distillation: | |
| IBP, ° F: | 490 |
| 5%, ° F: | 640° F |
| 95%, ° F: | 905 |

FCC main column bottoms are obtained by the catalytic cracking of gas oil in the presence of a solid porous catalyst. A more complete description of the production of this petroleum fraction is disclosed in U.S. Pat. No. 3,725,240.

It is believed that FCC main column bottoms is an excellent solvent for wood, coal, and the like, because it has a labile hydrogen content of about 0.3 percent or more, a benzylic hydrogen ($\alpha$) content of 1.5 percent or more, an aromatic hydrogen content of 2 percent or more, and a content of $\beta$, $\gamma$ and other hydrogen of 4 percent or less.

In the invention process, the thermally stable petroleum component performs as a solvent medium with respect to the solubilization of the comminuted wood. The petroleum solvent and wood components are admixed to form a slurry. The slurry thus formed is heated at a temperature in the range between about 350° F and 850° F, and preferably at a temperature between about 500° F and 750° F. In the invention process, a closed or open system under moderate or high pressures may be employed. It is not necessary to contact the liquefaction medium with a reducing gas such as hydrogen or synthesis gas although such a reducing gas treatment is not excluded by this invention.

The present invention process can be conducted in an open reactor system at atmospheric pressure, and without the use of catalysts or promoters. In the development of the present invention, it was unexpected that the cellulose and lignin constituents of wood could undergo thermal depolymerization to form lower molecular weight compounds, which in the invention process dissolves readily in the petroleum solvent without any substantial repolymerization or crosslinking to undesirable high molecular weight solids. Char is the major product of conventional low temperature wood carbonization and pyrolysis processes.

In the invention process, the slurry is heated for a reaction time sufficient to yield a pitch-like composition which upon cooling to ambient temperatures remains homogeneous and has a flowable consistency. The heating step of the invention process is conducted for a period of time between 0.2 and 3 hours, and preferably for a period of time between about 0.5 and 1.5 hours. Although it is not essential, the liquefaction reaction can be conducted under pressure and/or in the presence of a reducing gas (e.g., under a hydrogen pressure of about 100–2000 psi).

The petroleum solvent component in the liquefaction reaction mixture is provided in a quantity between about 0.5 and 10 parts by weight per part by weight of the comminuted wood component. Normally, the preferred ratio will be in the range between about 1.0 and 5 parts by weight of petroleum solvent per part by weight of wood.

In another important embodiment of the present invention, it has been discovered that the carbonaceous material solubilized in the highly aromatic petroleum solvent can be a mixture of comminuted wood and coal. It is particularly interesting and noteworthy that in the liquefaction coprocessing of wood and coal in accordance with the present invention process, the quantity of coal which can be solubilized and converted into liquid products is greatly enhanced in the presence of wood.

The quantities of wood and coal employed in the coprocessing procedure can vary in the range between about 0.1 and 10 parts by weight of wood per part by weight of coal. In a typical invention process run, the wood and coal are employed in approximately equal proportions by weight.

The nominal analyses of various coals suitable for use in the invention process are as follows:

| | |
|---|---|
| High Volatile A Bituminous (Coal) | |
| Sulfur | 1.33% |
| Nitrogen | 1.63 |
| Oxygen | 7.79 |
| Carbon | 80.88 |
| Hydrogen | 5.33 |
| Ash | 2.77 |
| Sub Bituminous (Coal) | |
| Sulfur | 0.21% |
| Nitrogen | 0.88 |

-continued

| | |
|---|---|
| Oxygen | 15.60 |
| Carbon | 65.53 |
| Hydrogen | 5.70 |
| Ash | 3.99 |
| Lignite | |
| Sulfur | 0.53% |
| Nitrogen | 0.74 |
| Oxygen | 32.04 |
| Carbon | 54.38 |
| Hydrogen | 5.42 |
| Ash | 5.78 |

The homogeneous pitch-like compositions which are the resultant products of the present invention process can be directly utilized as liquid fuel, such as in heavy oil fired stationary power generators. It is an important advantage of the present invention that the preferred compositions which are produced meet the specifications of No. 6 fuel oil. If desired, the invention compositions can be deashed (e.g., by filtration, centrifugation, selective precipitation, and the like) to yield a fuel which meets the specifications of the more valuable No. 5 fuel oil.

It is also within the scope of this invention to modify the physical properties of the homogeneous pitch-like compositions by one or more additional procedures. For example, cutting stock can be added in variable proportions to change the flow characteristics of the composition. Suitable cutting stocks include kerosene and light gas oil fractions. The compositions can be diluted with cutting stocks over a broad range of between about 0.1 and 10 volumes of cutting stock per volume of invention composition. The inclusion of cutting stock facilitates filtration or other separation means employed to separate the solids phase of ash and other insoluble materials from the fluid liquefaction phase.

It is another embodiment of this invention to subject the products of the invention process to modification by steps which include (1) deashing and the removal of other insoluble solids; and (2) removal of the petroleum solvent component by distillation to yield solvent-refined wood or wood/coal derivatives.

The following examples are further illustrative of the present invention. The reactants and other specific ingredients are presented as being typical, and various modifications can be derived in view of the foregoing disclosure within the scope of the invention.

EXAMPLE I

Pin oak wood (60 grams) was comminuted and then slurried in main column bottoms liquid (90 grams). The slurry was heated to 650° F for one hour during which time the slurry converted to a substantially homogeneous fluid. Extraction of this product with pyridine indicated that over 95 percent of the product composition was pyridine soluble.

EXAMPLE II

Conversion of wood to a pyridene-soluble oil fraction with 95 weight percent efficiency was attained by dissolving wood in FCC main column bottoms at temperatures of about 600° F - 750° F in the absence of any added reducing gases such as hydrogen or synthesis gas.

Pitch-like compositions which were flowable at room temperature were prepared at solvent to wood weight ratios as low as 1:1. Only sufficient pressure to maintain the solvent in the liquid state was required for dissolution of the wood.

Exceptionally high conversions of wood, and absence of carbonaceous residues, would seem to indicate that the wood depolymerizes during pyrolysis; but the presence of a highly solvating medium (i.e., FCC main column bottoms) for the low molecular reaction products sharply decreases the rate of crosslinking and stabilizes the reaction products as lower molecular weight oils.

Table i discloses the results of liquefaction of various hard woods in FCC main column bottoms, FCC heavy cycle oil and 850+° F Agha Jari residuum at solvent to wood ratios varying between 2:1 and 1:1 over a temperature range of 700° F–750° F. With the exception of Agha Jari residuum, the conversion yields were high.

In the case of the Agha Jari residuum, the low conversion yields are indicative of thermodynamic and kinetic factors such as repolymerization and crosslinking of low molecular weight intermediates, coking and cracking of the Agha Jari residuum, and loss of solvent.

Table I

Conversion of Wood To Oil In Aromatic Petroleum Fractions

| Run | Wood-Type | Temperature, ° F | Time, hr. | Oil | Oil/Wood, wt/wt | Conversion[1] |
|---|---|---|---|---|---|---|
| 1 | Pin Oak, dust | 750 | 1 | Main Column Bottoms | 2 | 89) repeat 95) extractions |
| 2 | Pin Oak, dust | 750 | 1 | Heavy Cycle Oil | 1 | 72 |
| 3 | White Oak, dust | 725 | 1 | Heavy Cycle Oil, 850+ ° F | 1 | 90 |
| 4 | Sawdust | 750 | 1 | Heavy Cycle Oil | 1.5 | 97 |
| 5 | Sawdust | 750 | 1 | Agha Jari, 850+ ° F | 1.5 | 52 |
| 6 | Sawdust | 700 | 3 | Agha Jari, 850+ ° F | 1.5 | −10 |
| 7 | Pine/Fir, sawdust | 750 | 0.5 | FCC Main Column Bottoms | 1.5 | 100 |
| 8 | Pine/Fir, sawdust | 600 | 0.75 | FCC Main Column Bottoms | 1.5 | 100 |
| 9 | Pine/Fir, sawdust | 600 | 1 | FCC Main Column Bottoms | 1.5 | 99 |

[1]Pyridine soluble portion, moisture-ash-free(MAF) basis, includes conversion to gaseous products.

EXAMPLE III

The following Table II discloses the results of liquefaction of comminuted soft wood in FCC main column bottoms under different processing conditions. The fourth column in Table II for comparison purposes reports the results obtained by the Bureau of Mines for the liquefaction of wood in tetralin under high hydrogen pressure. Table II lists the yields of benzene soluble and benzene insoluble fractions obtained from the wood, and lists the precentage of wood converted into water, gas and carbon (i.e., unreacted wood).

The higher temperature (750° F) increased dehydration, and even in a shorter reaction time more water was produced. This decreased the yield of liquid products.

The analyses of the gases from Runs A–C in Table II, are summarized in Table III, and the BTU values per cubic foot of the gas mixtures are indicated.

As a processing procedure in each of Runs A–C, pine/fir sawdust (60 grams) containing 12.8 grams of moisture was charged to a 300 cc stirred autoclave which contained FCC main column bottoms (90 grams) as a solvent medium. The reactor was sealed and brought to reaction temperature in about 45 minutes, and maintained at the reaction temperature for the desired reaction period before cooling to room temperature.

The gases were vented at 77° F through a weighed drying tube to a gas collection bomb. The gases were analyzed by vapor phase chromatography or mass spectrometry.

A portion of the liquid product was extracted with pyridine in a Soxhlet extractor. Extraction residue was weighed, and ashed at 1500° F for 16 hours. After vacuum distillation of the pyridine, the residual material was extracted with benzene to determine benzene insolubles.

In accordance with the data obtained, nominally at 600° F and 0.75 hr. reaction time the converted wood starting material yielded 58.6 weight percent liquid product, 19.8 weight percent gas product, and 22.5 weight percent water, based on MAF weight of the wood. The gas product contained about 51 weight percent $CO_2$, 27 weight percent CO and 6 weight percent $CH_4$, with a heating value of about 400–500 BTUs per cubic foot. This is a valuable clean gaseous fuel.

Of the oxygen content initially present in the wood starting material, 23 weight percent was transferred into the process liquid product, while 51 weight percent was converted into water and 27 weight percent into carbon oxides.

Of the hydrogen content initially present in the wood starting material, 33.7 weight percent was transferred into the process liquid product, while 43.7 weight percent and 22.6 weight percent were converted into water and carbon oxides, respectively.

Nominally, the process liquid product exhibited 100 weight percent solubility in pyridine, and 48.8 weight percent solubility in benzene.

Table II

Yields and Compositions of Wood Products From Liquefaction with FCC Bottoms

| Run | A | B | C | Bureau of Mines[5] |
|---|---|---|---|---|
| Operation Conditions | | | | |
| Temp., ° F | 750 | 600 | 600 | 770 |
| Time, hr | 1/2 | 3/4 | 1 | 3 |
| Initial Press.,psig. | 0 | 0 | 0 | 1800 |
| Conversion, wt. %[1] | 100 | 100 | 99 | 100 |
| Product Yield, wt. %[1] | | | | |
| Liquid Product | 53.9 | 58.6 | 64 | 50 |
| Benzene Soluble | 8.5 | 28.0 | 12.9 | — |
| Benzene Insoluble[2] | 45.4 | 30.6 | 51.1 | — |
| Gas | 18.9 | 19.8 | 15.2 | 18 |
| Water | 26.2 | 22.5 | 20.8 | 32 |
| Unreacted Wood + Carbon | nil | nil | 0.7 | — |
| Product Quality | | | | |
| Benzene Soluble[3] | | | | |
| %C | —[6] | 76.7 | —[6] | — |
| %H | — | 4.8 | — | — |
| %O | — | 18.5 | — | — |
| Benzene Insoluble | | | | |
| %C | 85.01 | 82.17 | 79.05 | — |
| %H | 4.71 | 5.17 | 5.06 | — |
| %O | 8.02 | 10.51 | 12.94 | — |
| Oxygen Distribution[4] | | | | |
| $CO_x$ | 26.4 | 27.3 | 25.5 | — |
| $H_2O$ | 54.5 | 50.5 | 45.3 | — |
| Liquid Product | 25.5 | 22.7 | 29.2 | — |
| Hydrogen Distribution[4] | | | | |
| Liquid Product | 33.0 | 45.6 | 56.8 | — |
| Gas | 3.3 | 3.7 | 1.2 | — |
| $H_2O$ | 63.7 | 54.4 | 42.0 | — |

[1]Wt. % MAF Wood
[2]Benzene Insoluble, pyridine soluble
[3]Solvent Free Basis
[4]Wt. % of initial hydrogen and oxygen in the wood
[5]Bureau of Mines Technical Paper #646, Pt III, 1942
[6]Not analyzed Table III Gas Compositions of Wood Products From Liquefaction in FCC Bottoms

| | A | | B[1] | | C[2] | |
|---|---|---|---|---|---|---|
| Run | Wt. % | mol % | Wt. % | | Wt. % | mol % |
| $CO_2$ | 56.3 | 44.1 | 50.8 | 41.1 | 84.4 | 69.9 |
| CO | 30.0 | 36.8 | 27.0 | 34.2 | 12.9 | 16.8 |
| $C_1$ | 6.4 | 14.5 | 5.8 | 12.8 | 0.6 | 1.4 |
| $C_2$ | 2.5 | 2.8 | 3.2 | 3.9 | 0.3 | 0.4 |
| $C_3$ | 1.5 | 1.0 | 3.5 | 2.9 | 0.3 | 0.3 |
| $C_4$ | 0.5 | 0.3 | 3.1 | 1.8 | 0.4 | 0.2 |
| $C_5$ | 0.3 | — | 2.1 | 1.1 | 0.2 | 0.1 |
| $C_6$ | 0.1 | — | 4.4 | 1.8 | — | — |
| $C_{6+}$ | 2.3 | 0.7 | 0.1 | — | — | — |
| $H_2$ | — | — | — | — | 0.6 | 10.6 |
| | 99.9 | 100.2 | 100.07 | 99.6 | 99.7 | 99.7 |
| BTU/SCF | 383 | | 570 | | 129 | |

[1]Analyses by vapor phase chromatography
[2]Analyses by mass spectrometer

EXAMPLE IV

This Example illustrates the increased percentage of coal which can be solubilized in a highly aromatic refinery petroleum solvent when coprocessed with wood in accordance with the present invention.

A. Lignite coal (50 grams) and FCC main column bottoms liquid (100 grams) were charged to an autoclave. The slurry was heated at constant agitation of 1000 rpm for one hour at a temperature of 750° F without added hydrogen. Under these conditions, 65 weight percent of the coal was solubilized.

B. Lignite coal (25 grams), pin oak chips (25 grams) and FCC main column bottoms liquid (100 grams) were charged to an autoclave, and heated at 750° F for one hour without added hydrogen.

In the presence of comminuted wood, 90 weight percent of the coal was solubilized.

We claim:

1. A process for liquefaction of solid carbonaceous materials which comprises forming a slurry by admixing comminuted wood with a petroleum solvent selected from thermally stable petroleum refinery FCC main column bottoms and TCC syntower bottoms having a boiling point between about 450° F and 1100° F, and heating said slurry at a temperature in the range between about 350° F and 850° F for a period of time sufficient to convert the slurry into a homogeneous composition which has a flowable pitch-like consistency at standard temperature.

2. A process in accordance with claim 1 wherein the said slurry is heated for a period of time betwen about 0.2 and 3 hours.

3. A process in accordance with claim 1 wherein the petroleum solvent component in the slurry admixture is present in a quantity between about 0.5 and 10 parts by weight of petroleum solvent per part by weight of wood.

4. A process in accordance with claim 1 wherein the said homogeneous composition product consists of a fluid liquefaction phase and an insoluble solids phase, and before cooling, is subjected to a procedure for separating the fluid liquefaction phase from the insoluble solids phase.

5. A process for liquefaction of solid carbonaceous materials which comprises forming a slurry by admixing comminuted wood and coal with a petroleum solvent selected from thermally stable petroleum refinery FCC main column bottoms and TCC syntower bottoms having a boiling point between about 450° F and 1100°

F, and heating said slurry at a temperature in the range between about 350° F and 850° F for a period of time sufficient to convert the slurry into a homogeneous composition which has a flowable pitch-like consistency at standard temperature.

6. A process in accordance with claim 5 wherein the said slurry is heated for a period of time between about 0.2 and 3 hours.

7. A process in accordance with claim 5 wherein the ratio of wood to coal in the slurry admixture varies in the range between about 0.1 to 10 parts by weight of wood per part of coal.

8. A process in accordance with claim 5 wherein the petroleum solvent component in the slurry admixture is present in a quantity between about 0.5 and 10 parts by weight of petroleum solvent component per part of the combined weight of wood and coal components in the slurry admixture.

9. A process in accordance with claim 5 wherein the said homogeneous composition product consists of a fluid liquefaction phase and an insoluble solids phase, and before cooling, is subjected to a procedure for separating the fluid liquefaction phase from the insoluble solids phase.

* * * * *